US008579529B2

(12) United States Patent
Pechko et al.

(10) Patent No.: US 8,579,529 B2
(45) Date of Patent: Nov. 12, 2013

(54) MULTI-UNIT COSMETIC APPLICATOR

(75) Inventors: Andrew H. Pechko, Ridgewood, NJ (US); John S. Kurek, Goshen, NY (US)

(73) Assignee: Avon Products, Inc, New York, NY (US)

( * ) Notice: Subject to any disclaimer, the term of this patent is extended or adjusted under 35 U.S.C. 154(b) by 511 days.

(21) Appl. No.: 11/818,027

(22) Filed: Jun. 13, 2007

(65) Prior Publication Data

US 2008/0193193 A1 Aug. 14, 2008

Related U.S. Application Data

(60) Provisional application No. 60/900,369, filed on Feb. 8, 2007.

(51) Int. Cl.
*B43K 27/00* (2006.01)
*B05C 1/00* (2006.01)

(52) U.S. Cl.
USPC ..... 401/31; 401/17

(58) Field of Classification Search
USPC ..... 401/16, 19, 22, 23, 25–34, 116, 52, 68, 401/75–79, 72, 35, 197, 198, 17, 20; 132/317, 318; 222/139, 140, 131
See application file for complete search history.

(56) References Cited

U.S. PATENT DOCUMENTS 2,129,051 A * 9/1938 Eastley ..... 401/19
2,491,980 A * 12/1949 Hines ..... 401/32
2,591,027 A * 4/1952 Turnes ..... 401/19
2,653,339 A * 9/1953 Mureau ..... 401/19
2,710,614 A 6/1955 Dulberg
3,001,531 A 9/1961 Gazdik
3,320,962 A 5/1967 Moriber et al.
4,291,018 A * 9/1981 Oeda et al. ..... 424/64
4,740,097 A * 4/1988 Kapustin ..... 401/35
5,026,189 A * 6/1991 Keil ..... 401/29
5,111,972 A 5/1992 Sakurai et al.
5,178,478 A 1/1993 Ryder
5,881,742 A 3/1999 Hunsberger
6,106,179 A 8/2000 Kuo
6,386,781 B1 * 5/2002 Gueret ..... 401/198
6,497,524 B1 12/2002 Kim
6,543,458 B1 4/2003 Ohba
6,695,510 B1 * 2/2004 Look et al. ..... 401/68
6,773,184 B2 8/2004 An
6,895,628 B1 5/2005 Anderson
6,896,433 B1 5/2005 Zhang et al.
7,147,392 B2 * 12/2006 Bedhome et al. ..... 401/35
7,156,571 B2 * 1/2007 Mook et al. ..... 401/29
7,168,875 B1 1/2007 Zhang et al.

(Continued)

FOREIGN PATENT DOCUMENTS

EP 0443819 A2 8/1991
JP 11113631 A2 4/1999
JP 3115404 U 11/2005

*Primary Examiner* — David Walczak
*Assistant Examiner* — Jennifer C Chiang
(74) *Attorney, Agent, or Firm* — David M. Joyal; Joan M. McGillycuddy

(57) ABSTRACT

A multi-unit cosmetic applicator comprising: a housing body, a first cosmetic unit housed in the housing body, a second cosmetic unit housed in the housing body, an opening in the housing, wherein each cosmetic unit has a means for being independently movable relative to each other from a stored position to an advanced position and back to its stored position.

9 Claims, 11 Drawing Sheets

(56) References Cited

U.S. PATENT DOCUMENTS

| | | | | |
|---|---|---|---|---|
| 7,290,955 | B2 * | 11/2007 | Patel et al. | 401/264 |
| 7,309,184 | B2 | 12/2007 | Butcher et al. | |
| 2002/0071707 | A1 | 6/2002 | Breidenbach et al. | |
| 2004/0234321 | A1 | 11/2004 | Breidenbach et al. | |
| 2005/0063766 | A1 | 3/2005 | Chen et al. | |
| 2005/0065463 | A1 | 3/2005 | Tobinaga et al. | |
| 2005/0100388 | A1 | 5/2005 | Bedhome et al. | |
| 2008/0014163 | A1 | 1/2008 | Grabiner et al. | |
| 2009/0232579 | A1 * | 9/2009 | Obereisenbuchner et al. | 401/17 |

* cited by examiner

MULTI-UNIT COSMETIC APPLICATOR

This application claims priority under 35 U.S.C. 119(e) to U.S. provisional application No. 60/900,369, filed on Feb. 8, 2007, the contents of which are herein incorporated by reference in their entirety.

BACKGROUND OF THE INVENTION

The present invention relates to applicators for applying a product to the body of the consumer; in particular, to a cosmetic applicator having at least multiple cosmetic units wherein one unit is independently movable with respect to the other units.

DISCUSSION OF THE PRIOR ART

Cosmetic applicators are designed to deliver a cosmetic agent such as lip gloss, mascara, lip liner, concealer, foundation, eye shadow and eyeliner, etc from a cosmetic unit. The cosmetic unit may be a solid, a liquid reservoir, or the like. Due to ease of design and manufacturing, applicators typically house only one cosmetic unit.

Thus, users must carry a variety of applicators. For example, when applying a lip gloss, it might be useful to also have a lip liner available. Thus, the user must remember to carry both items. This, of course, requires the number of items to carry and reduces the space needed to carry the items.

A need, therefore, exists for a simpler and easier to use cosmetic applicator that also avoids the known shortcomings of only having one cosmetic unit in a housing.

Even when a user carries all items with them, it may be that the cosmetic agents being used are incompatible. In the example above, the lip gloss may include ingredients that react adversely with the lip liner. The conflict may be relatively minor, liquefaction or smearing of one or the other cosmetic agent, to serious, burning or allergic reactions on the user's skin.

Thus, a further need exists for the delivery of cosmetic agents that are compatible with each other. Since cosmetic agents may have different physical states, typically liquid, solid, or amorphous, a need exists for the cosmetic applicator to deliver such compatible cosmetic agents in their state.

SUMMARY OF THE INVENTION

The needs are met by the present invention. Therein, a cosmetic applicator for dispensing at least a first and a second cosmetic agent on the skin of a user comprises housing having an inner space, a first cosmetic unit comprising the first cosmetic agent disposed in the housing, a second cosmetic unit comprising the second cosmetic agent disposed in the housing, and a means for advancing the second cosmetic unit relative to the first cosmetic unit from a stored position to an advanced position.

The means for advancement may be a slide assembly, a twist assembly, and/or a push button and spring assembly.

BRIEF DESCRIPTION OF THE DRAWINGS

The above and other features and advantages will become more readily apparent from a detailed description taken in conjunction with the following drawings, in which.

DETAILED DESCRIPTION OF THE INVENTION

Herein, "cosmetic agent" is used to denote the cosmetic that is applied to the user, while "cosmetic unit" is used to designate the physical formation that includes the cosmetic agent. For example, the lipstick components that are used to cover and/or enhance the lips of the user are the cosmetic agent, while the molded, typically cylindrical, form of the lipstick transported and used from the applicator is the cosmetic unit. Similarly, the liquid in a reservoir would be the cosmetic agent, while the reservoir is the cosmetic unit. One skilled in the art would understand the above not to be an exhaustive list.

With respect to FIGS. 1 and 2, in a first embodiment of the present invention, a multi-unit cosmetic applicator includes a first cosmetic unit and a second cosmetic unit that is movable with respect to the first cosmetic unit from a stored position to an advanced position via a slide assembly.

Herein, a "stored position" is when the second cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Figure 1A:
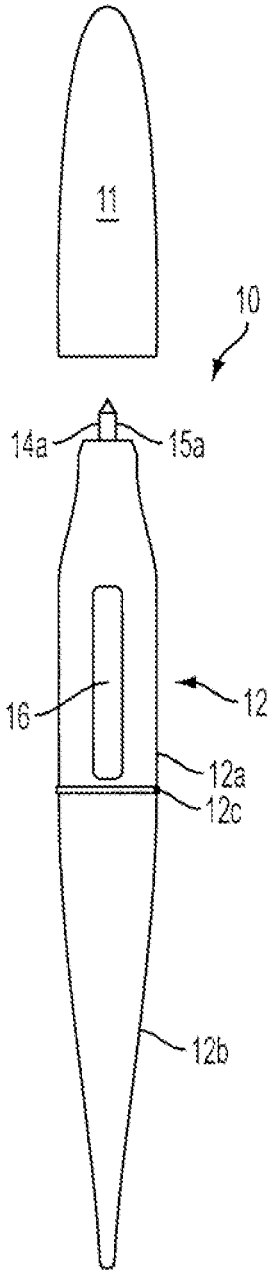
FIGS. 1*a* and 1*b* are front perspective views of a multi-unit cosmetic applicator in accordance with a first embodiment of the invention.
Figure 1B:
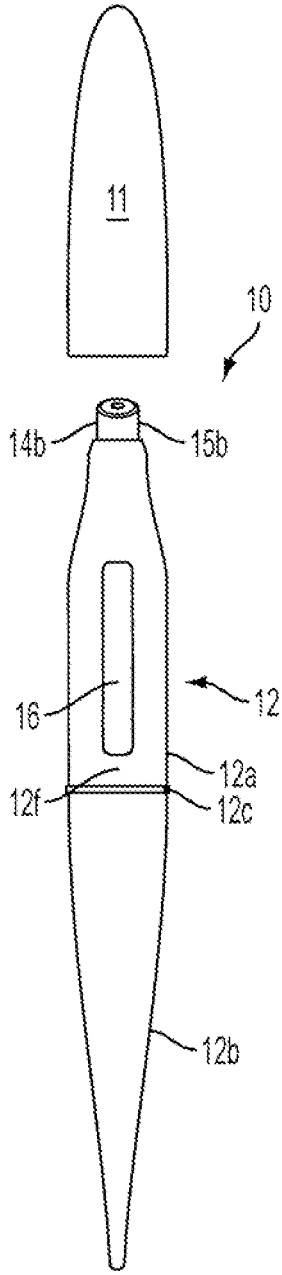
Figure 2A:
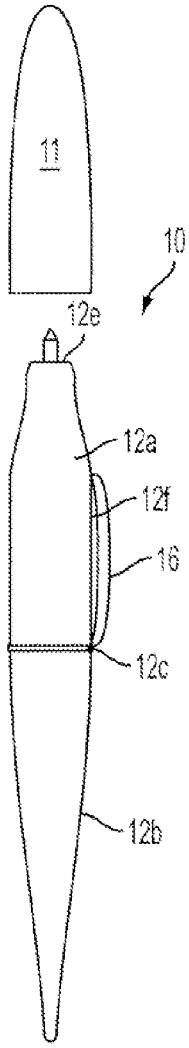
FIGS. 2*a*-2*c* are, respectively, a right-side view of a multi-unit cosmetic applicator in accordance with the first embodiment of the present invention, a front view of a dual cosmetic applicator thereof and a cross-sectional view of a dual cosmetic applicator thereof taken along line B-B of FIG. 2*b*.
Figure 2B:
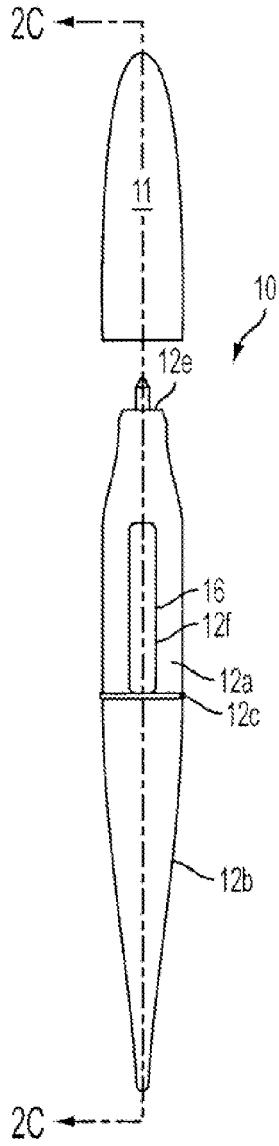
Figure 2C:
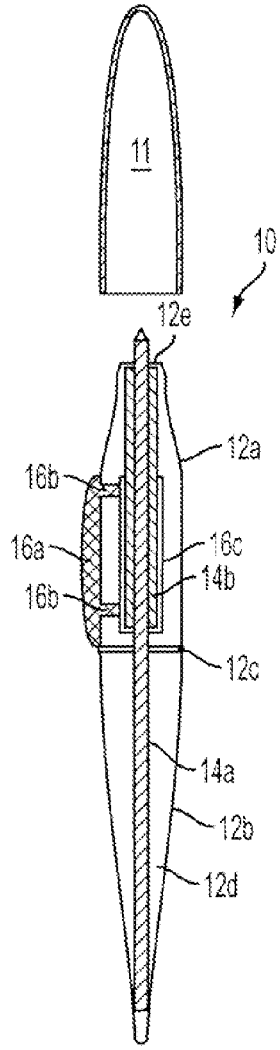

Therein, FIGS. 1*a* and 1*b* are front perspective views of a multi-unit cosmetic applicator 10 in accordance with a first embodiment of the invention. FIGS. 2*a*-2*c* are, respectively, a right-side view of multi-unit cosmetic applicator 10, a front view of multi-unit cosmetic applicator 10, and a cross-sectional view of multi-unit cosmetic applicator 10 taken along line B-B of FIG. 2*b*.

Preferably, multi-unit cosmetic applicator 10 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 10 includes a cap 11 and a housing 12. Cap 11 is preferably sized to fit over a substantial portion of an upper housing body 12*a* that is sealed via a sleeve 12*c* from a lower housing body 12*b*.

Lower body 12*b* comprises an inner space 12*d* that may be a void space or may be configured as a reservoir for a first cosmetic agent used by a first cosmetic unit 14*a*. Upper body 12*a* defines a substantially longitudinal inner space that primarily houses a second cosmetic unit 14*b* and the means to advance the second cosmetic unit relative to the first.

Housing 12 preferably is designed to have an attractive shape and yet be ergonomically designed to fit in the user's hand. An ergonomic design may include any desired shape that is found to be suitable. As illustrated, lower body 12*b* may be shaped to taper to a tip while upper housing body 12*a* has a broader, fuller shape.

Upper housing body 12*a* includes an opening 12*e*, suitable for passing both the first cosmetic unit 14*a* and the second cosmetic unit 14*b* through such an opening. Opening 12*e* defines a proximal end of housing 12, while the tip of lower body housing 12*b* defines a distal end. Upper housing body 12*a* also includes a substantially longitudinally oriented notch 12*f* into which a slider assembly 16 is fitted.

First cosmetic unit 14*a* preferably has a small width to length ratio and reaches well into inner space 12*d* to wick the first cosmetic agent. For example, cosmetic unit 14*a* may have a pencil lead shape, one that is substantially cylindrical in cross-section and has a significant length. Therein, cosmetic unit 14*a* extends the entire length of housing 12 and extends a portion beyond the proximal end of housing 12 to provide a user accessible portion 15*a*.

In contrast, second cosmetic unit 14*b* comprises a second cosmetic agent and preferably has greater width to length ratio than the first cosmetic unit 14*a*. For example, second cosmetic unit 14*b* has a lipstick shape, one that is substantially cylindrical in cross-section and is relatively shorter than the first cosmetic unit.

Cosmetic unit 14*b* is disposed about cosmetic unit 14*a* and, thus, includes longitudinal channel 14*c* that accommodates the first cosmetic unit 14*a*. Channel 14*c* extends longitudinally through the second cosmetic unit 14*b* and may have any suitable cross-sectional shape that permits the cosmetic unit 14*b* to move unimpeded relative to the first cosmetic unit. Thus, it should be appreciated that channel 14*c* includes a peripheral clearance about cosmetic unit 14*a*.

Using the slider assembly (to be taught hereinafter), the second cosmetic unit is selectably moved relative to the first cosmetic unit from a stored position in housing 12 (FIG. 1*a*) so that a user accessible portion 15*b*, of any length, of the second cosmetic unit 14*b* extends beyond the distal end of the housing (FIG. 1*b*).

Therein, for example, cosmetic unit 14*a* may be a lip liner, which has a diameter significantly smaller than the second cosmetic unit 14*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 10 includes a slider assembly 16. Slider 16 may include a button 16*a* having a textured surface to provide a tactile response to the user. Slider assembly 16 includes spaced apart arms 16*b* that connect to a sleeve 16*c* that retains the second cosmetic unit. Sleeve 16*c* preferable includes a transverse floor that has an opening of a size suitable for permitting the movement of the second cosmetic unit relative to the first.

When the user pushes slider assembly 16 via button 16*a*, longitudinally towards the opening and the housing 12*d*, the second cosmetic unit 14 advances through the opening 12*d* and a portion 15*b* is suitably located for a user.

With respect to FIGS. 3 and 4, in a second embodiment of the present invention, a multi-unit cosmetic applicator includes a first housing portion that rotates relative to a second housing portion and advances a second cosmetic agent relative to a first cosmetic agent from a stored position to an advanced position.

Figure 3A:
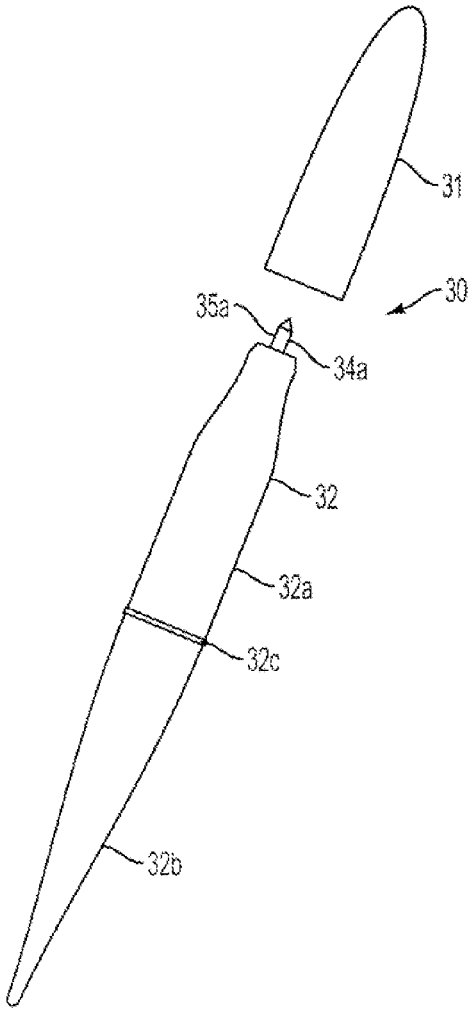
FIGS. 3*a* and 3*b* are perspective views of a multi-unit cosmetic applicator in accordance with the second embodiment of the invention.
Figure 3B:
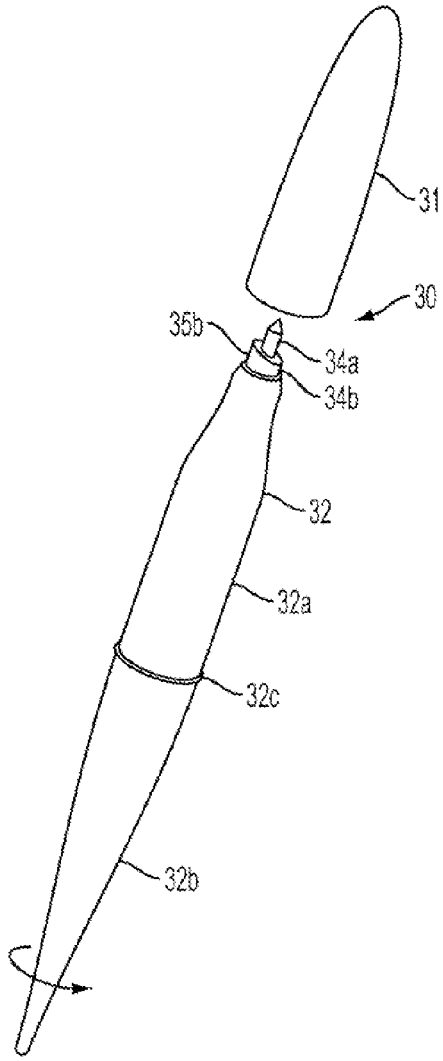
Figure 4A:
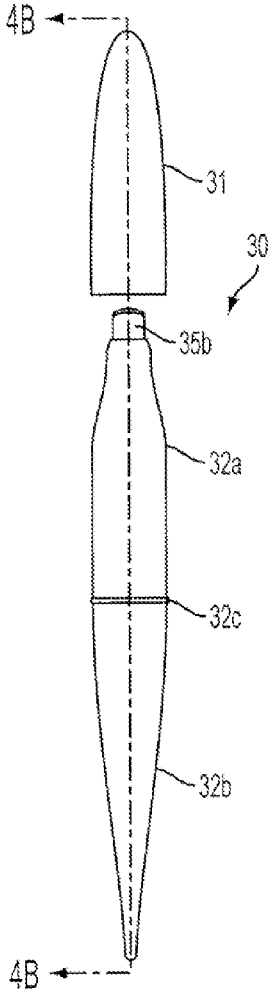
FIGS. 4*a*-4*c* are, respectively, a front view of multi-unit cosmetic applicator of the second embodiment of the present invention in an advanced position, a cross-sectional view of a dual cosmetic applicator thereof taken along line A-A of FIG. 4*a*, and a see-through view of a dual cosmetic applicator thereof in an advanced position.
Figure 4B:
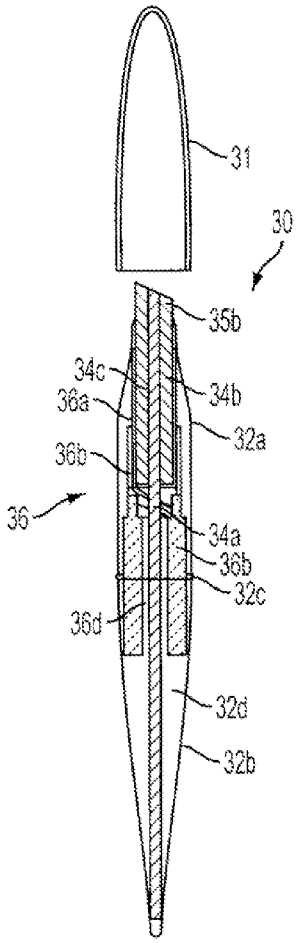
Figure 4C:
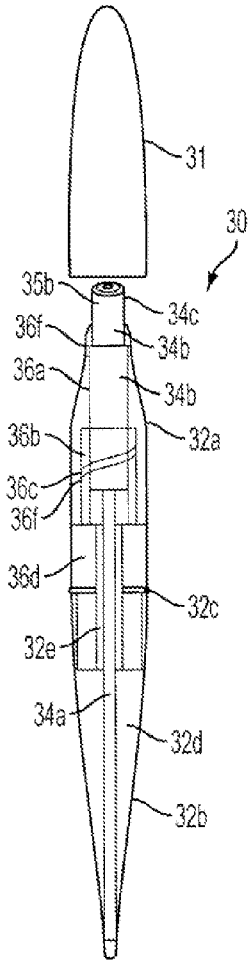

Therein, FIGS. 3*a* and 3*b* are perspective views of a multi-unit cosmetic applicator 30 in accordance with the second embodiment of the invention. FIGS. 4*a*-4*c* are, respectively, a front view of cosmetic applicator 30 in an advanced position, a cross-sectional view of cosmetic applicator 30 taken along line A-A of FIG. 4*a*, and a see-through view of cosmetic applicator 30 in an advanced position.

Preferably, multi-unit cosmetic applicator 30 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Therein, cosmetic applicator 30 includes a cap 31 and a housing 32. Cap 31 is preferably sized to fit over a substantial portion over an upper housing body 32*a* that is sealed via a sleeve 32*c* from a lower body 32*b*.

Lower housing body 32*b* comprises an inner space 32*d* which may be configured as a void space or a reservoir for a first cosmetic agent used by a first cosmetic unit 34*a*. Upper body 32*a* defines a substantially longitudinal inner space that primarily houses a second cosmetic unit 34*b* and the means to advance the second cosmetic unit relative to the first.

Similar to multi-unit cosmetic applicator 10, herein, the first cosmetic unit 34*a* preferably has a small width to length ratio and reaches well into inner space 32*d* to wick the first cosmetic agent. For example, cosmetic unit 14*a* may have a pencil lead shape, one that is substantially cylindrical in cross-section and has a significant length. Therein, cosmetic unit 34*a* extends the entire length of housing 32 and extends a portion beyond the proximal end of housing 32 to provide a user accessible portion 35*a*.

In contrast, second cosmetic unit 34*b* comprises a second cosmetic agent and preferably has greater width to length ratio than the first cosmetic unit 34*a*. For example, second cosmetic unit 34*b* has a lipstick shape, one that is substantially cylindrical in cross-section and is relatively shorter than the first cosmetic unit.

Cosmetic unit 34*b* is disposed about cosmetic unit 34*a* and, thus, includes longitudinal channel 34*c* that accommodates the first cosmetic unit 34*a*. Channel 34*c* extends longitudinally through the second cosmetic unit 34*b* and may have any suitable cross-sectional shape that permits the cosmetic unit

34*b* to move unimpeded relative to the first cosmetic unit. Thus, it should be appreciated that channel 34*c* includes a peripheral clearance about cosmetic unit 34*a*. In one embodiment, cosmetic unit 34*a* is anchored at a distal end of body 32*b*.

Using the twist assembly (to be taught hereinafter), the second cosmetic unit is selectably moved relative to the first cosmetic unit from a stored position in housing 32 (FIG. 3*a*) so that a user accessible portion 35*b*, of any length, of the second cosmetic unit 14*b* extends beyond the distal end of the housing (FIG. 3*b*).

Therein, for example, cosmetic unit 34*a* may be a lip liner, which has a diameter significantly smaller than the second cosmetic unit 34*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 30 includes a twist assembly 36. Twist assembly 36 includes a sleeve 36*a* that houses the second cosmetic unit 34*b* and a plug 36*b* configured to include a helical guide 36*c* and cylinder 36*d* having a channel 36*e*.

An upper portion of plug 36*b* fits within the upper housing body 32*a* while a lower portion comprising approximately half of cylinder 36*c* is disposed in lower housing body 32*b*. Therein, body 32*b* is rotatable with respect to body 32*a* and rotates with twist assembly 36. Thus, in essence, the lower portion of the cosmetic applicator rotates, while the upper portion of the body is still and the cosmetic unit is advanced longitudinally.

Sleeve 36*a* further includes spaced-apart pins 36*f* that travel in guide 36*c* and is keyed to body 32*a* in an inner peripheral groove disposed on body 32*a*. Guide 36*c* is disposed in the interior surface of the sleeve and is shaped to have a helical surface. By rotating lower housing body 32*b*, the sleeve twists and moves with respect to the axis of multi-unit applicator 30.

With respect to FIGS. 5 and 6, in a third embodiment of the present invention, a multi-unit cosmetic applicator includes a first cosmetic unit and a second cosmetic unit that is movable with respect to the first cosmetic unit from a stored position to an advanced position via a push button and spring assembly.

Figure 5A:
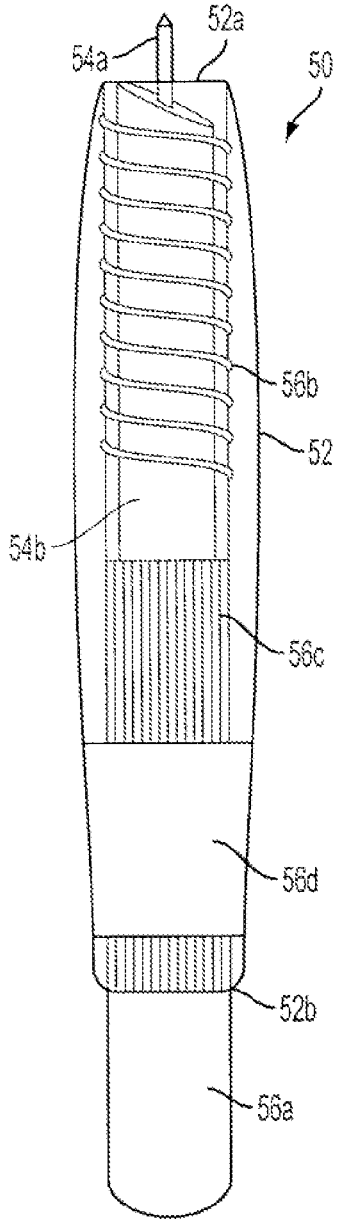
FIGS. 5*a* and 5*b* are front perspective views of a multi-unit cosmetic applicator in accordance with third embodiment of the invention.
Figure 5B:
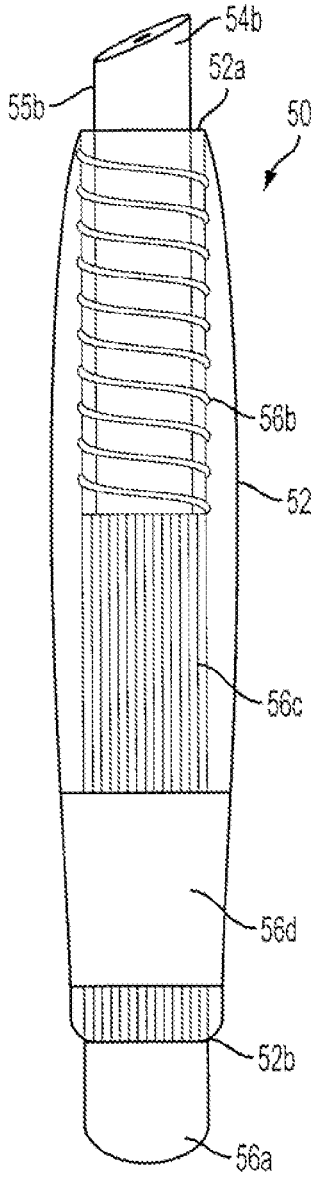
Figure 6A:
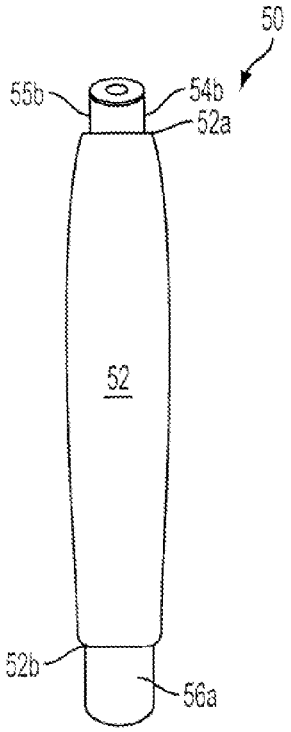
FIGS. 6*a*-6*c* are, respectively, a right-side view of multi-unit cosmetic applicator of the third embodiment of the present invention, a front view of a dual cosmetic applicator thereof, and a cross-sectional view of a multi-unit cosmetic applicator taken along line A-A of FIG. 6*b*.
Figure 6B:
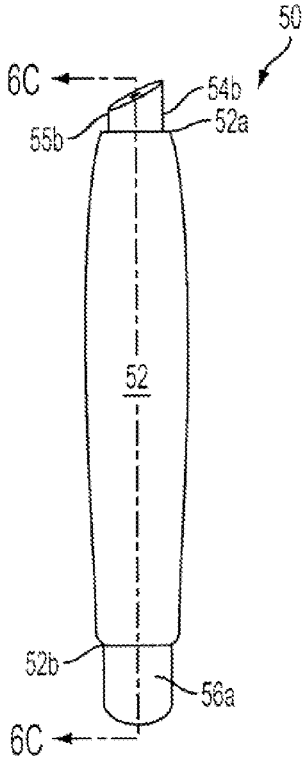
Figure 6C:
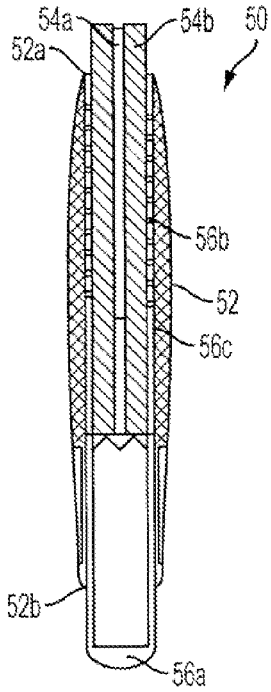

Therein, FIGS. 5*a* and 5*b* are front perspective views of multi-unit cosmetic applicator 50 in accordance with one embodiment of the invention wherein certain portions of the housing are shown translucent. FIGS. 6*a*-6*c* are, respectively, a right-side view of multi-unit cosmetic applicator 50, a front view of multi-unit cosmetic applicator 10, and a cross-sectional view of multi-unit cosmetic applicator 50 taken along line A-A of FIG. 6*b*.

Preferably, multi-unit cosmetic applicator 50 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 50 may include a cap not shown and a housing 52. The cap if provided is preferably sized to fit over a substantial portion of an upper portion of housing 52.

The housing defines a substantially longitudinal inner space that houses a first cosmetic unit 54*a*, a second cosmetic unit 54*b*, a spring that in conjunction with a push button advance the second cosmetic unit relative to the first cosmetic unit.

Housing 52 preferably is designed to have an attractive shape and yet be ergonomically designed to fit in the user's hand. An ergonomic design may include any desired shape that is found to be suitable.

Housing 52 comprises a proximal opening 52*a* suitable for passing both the first cosmetic unit 54*a* and the second cosmetic unit 54*b* through such an opening and a distal opening 52*b* wherein a push button (to be taught hereinafter) is disposed.

First cosmetic unit 54*a* preferably has a small width to length ratio and is anchored at distal opening 52*b*. For example, cosmetic unit 54*a* may have a pencil lead shape, one that is substantially cylindrical in cross-section and has a significant length. Therein, cosmetic unit 54*a* extends a portion of the length of housing.

In contrast, second cosmetic unit 54*b* comprises a second cosmetic agent and preferably has greater width to length ratio than the first cosmetic unit 54*a*. For example, second cosmetic unit 54*b* has a lipstick shape, one that is substantially cylindrical in cross-section and is relatively shorter than the first cosmetic unit.

Cosmetic unit 54*b* is disposed about cosmetic unit 54*a* and, thus, includes longitudinal channel 54*c* that accommodates the first cosmetic unit 54*a*. Channel 54*c* extends longitudinally through the second cosmetic unit 54*b* and may have any suitable cross-sectional shape that permits the cosmetic unit 54*b* to move unimpeded relative to the first cosmetic unit. Thus, it should be appreciated that channel 54*c* includes a peripheral clearance about cosmetic unit 54*a*.

Using the push button and spring (to be taught hereinafter), the second cosmetic unit is selectably moved relative to the first cosmetic unit from a stored position in housing 52 (FIG. 5*a*) so that a user accessible portion 55*b*, of any length, of the second cosmetic unit 54*b* extends beyond the distal end of the housing (FIG. 5*b*).

Therein, for example, cosmetic unit 54*a* may be a lip liner, which has a diameter significantly smaller than the second cosmetic unit 54*b*, such as a lip gloss. The first cosmetic units may be a solid, semi-solid or waxy product such as an eye pencil, eye liner, mascara, lipstick, lip liner, lip balm, brow definer, concealer, foundation, blush, etc.

To move the second cosmetic unit, multi-unit cosmetic applicator 50 includes a push button 56*a*, a spring 56*b*, and a sleeve 56*c*. Spring 56*b* is biased against sleeve 56*c*. Sleeve 56*c* is substantially cylindrical and retains a lower portion of second cosmetic unit 54*b*. Push button 56*a* is biased against the sleeve at a lower edge of the sleeve or is integral with the sleeve, while spring 56*b* is biased against the sleeve at an upper edge of the sleeve. Spring 56*a* is biased at a proximal edge against a peripheral rim of opening 52*a*. A substantially cylindrical guide 56*d* is retained in a lower part of housing 52 to limit the travel of the push button by engaging a proximal protrusion of the push button.

When the push button is depressed by the user, the second cosmetic unit moves relative to the first cosmetic unit via push button means as are known for example in a pen.

With regard to the embodiments of FIGS. 1-6, the first cosmetic unit, inner unit, comprises and delivers a liquid cosmetic agent. The liquid cosmetic agent may be, but is not limited, to skin treatment serums, lotions, solutions, sunscreen preparations, self-tanning preparations, color enhancing preparations, shine enhancing preparations, preparations that include film formers to improve wear resistant attributes, perspiration and moisture resistance properties; a rubefacient, cosmetics colorants, optical brighteners, glitter or fluorescent materials as desired for additional visual effects.

To do so, the cosmetic unit may comprise suitable natural and synthetic substrate materials that include, but are not limited, to cotton, flax, silk or polyesters, rayons, acrylics, acetates, triacetates, polyolefins, and lyocells. Such substrate materials can be impregnated with the liquid cosmetic agent for subsequent delivery during use of the first cosmetic unit. Preferred are highly absorbent substrate materials.

In one or more embodiments related to the embodiments of FIGS. 1-6, the first cosmetic unit, inner unit, rather than comprising and delivering a liquid cosmetic agent comprises and delivers a solid, semi-solid, or waxy cosmetic agent. Therein, each of the embodiments comprises a take-up mechanism that maintains a sufficient user accessible portion 15*a*, 35*a*, or 55*a* of the cosmetic unit external to the housing. Each of the cosmetic units comprises a cosmetic agent, the cosmetic agents of the cosmetic units each independently comprises one of an eye pencil, an eye liner, a mascara, a lipstick, a lip liner, a lip balm, blush, foundation, a brow definer, a concealer, a skin treatment, a serum, a lotion, a solution, a sunscreen preparation, a self-tanning preparation, and a color enhancing preparation. Each of the cosmetic units comprises a cosmetic agent, the cosmetic agent of the cosmetic unit each independently comprising one of a solid, semi-solid, gel, liquid and waxy structure.

Such a take up mechanism may be automatic such as a spring assembly or a manually where the user engages the first cosmetic unit and advances it forward.

In one or more embodiments related to the embodiments of FIGS. 1-6 or unrelated thereto, an outer cosmetic unit may comprise and deliver a liquid cosmetic agent. Thus, FIGS. 7-9 illustrate a fourth embodiment of a multi-unit cosmetic applicator in accordance with one embodiment of the present invention.

Figure 7B:
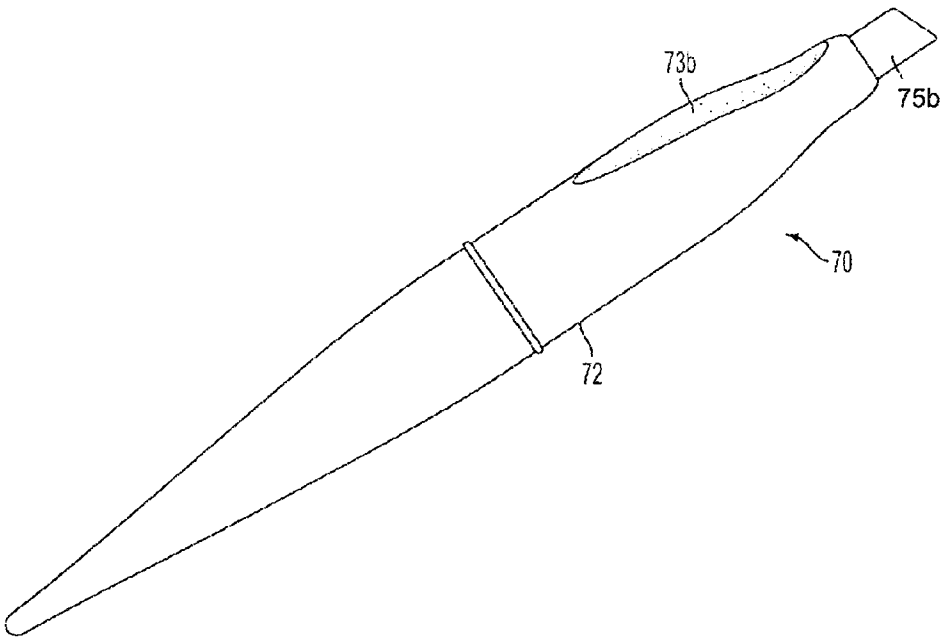
FIGS. 7*a* and 7*b* are front perspective views of a multi-unit cosmetic applicator in accordance with a fourth embodiment of the invention.
Figure 7A:
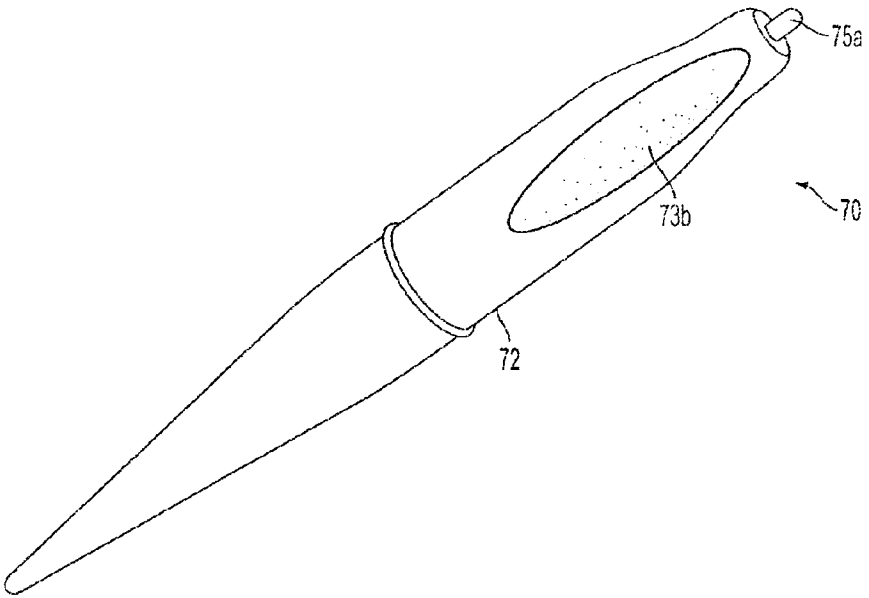
Figure 9A:
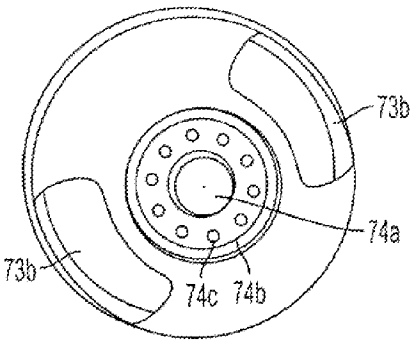
FIGS. 9*a* and 9*b* are top perspective views thereof.
Figure 8:
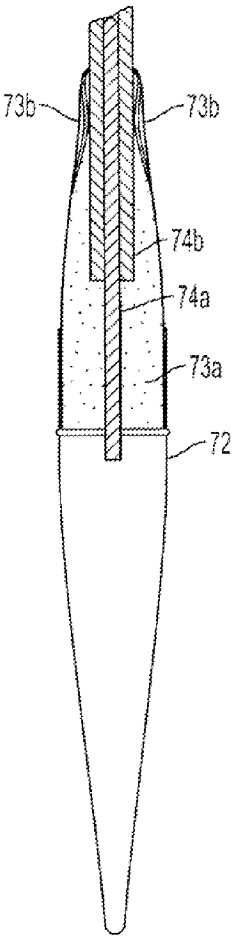
FIG. 8 is a cross-sectional view of the multi-unit cosmetic applicator thereof.

Therein, FIGS. 7*a* and 7*b* are front perspective views of multi-unit cosmetic applicator 70 in accordance with one embodiment of the invention. FIG. 8 is a cross-sectional view of the multi-unit cosmetic applicator thereof and FIGS. 9*a* and 9*b* are top perspective view thereof.

Multi-unit cosmetic applicator 70 may be constructed substantially in the same manner as taught with respect to any of the foregoing embodiments and having means to advance the second cosmetic unit, herein cosmetic unit 74*b*, relative to a first cosmetic unit, herein cosmetic unit 74*a*. The units are sized to substantially permit movement of the second cosmetic unit 74*b* relative to the first and advance a user accessible portion 75*b* external to housing 72 to deliver a second cosmetic agent. When the second cosmetic unit 74*b* is stored, a user accessible portion 75*a* of cosmetic unit 74*a* is external to the housing to deliver a first cosmetic agent.

Housing 72 preferably includes inner space 73*a* which may be a void space or may be usable as a reservoir for the second cosmetic agent. Therein, inner space 73*a* is preferably sealed from any other reservoir. One or more flexible housing portions 73*b* are disposed in fluid communication with inner space 73*a* to infuse the second cosmetic unit with the second cosmetic agent.

Figure 9B:
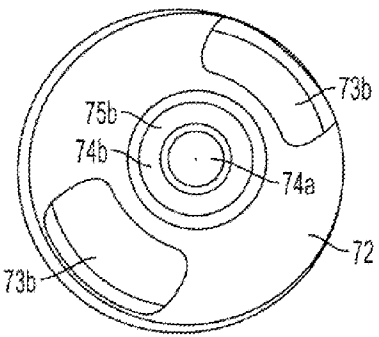

To permit advantageous delivery of the cosmetic agent at a proximal surface of cosmetic unit 74*b*, a plurality of apertures 74*c* (FIG. 9*a*) as opposed to a smooth surface (FIG. 9*b*). Each of the cosmetic units may vary in size to allow for controlled application to varying areas and to allow for variable dosage or step treatments.

With respect to FIGS. 10, 11, and 12, in a further embodiment of the present invention, a multi-unit cosmetic applicator includes a first, second, and third cosmetic unit that are movable with respect to each other and the housing from a stored position to an advanced position via one or more slide assemblies.

Herein, a "stored position" is when a cosmetic unit is retracted in the housing, while an "advanced position" is when a user accessible portion, of any length, of the second cosmetic unit is extended beyond the housing so that the user can place the cosmetic agent comprised in the cosmetic unit onto their body.

Although, the embodiment of FIGS. 10, 11, and 12 are illustrated with respect to three cosmetic units, limiting the number of cosmetic units and means to advance the cosmetic units to two or increasing the number of cosmetic units and means to advance the cosmetic units to four (4) or greater is also encompassed by the present embodiment.

Figure 10B:
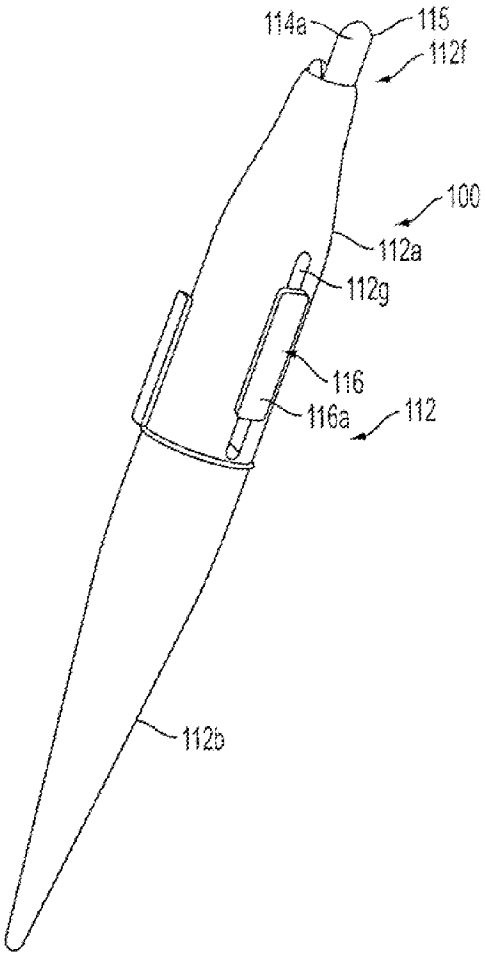
FIGS. 10*a* and 10*b* are, respectively, a right-side perspective view and a left-side perspective view, as of a multi-unit cosmetic applicator in accordance with a further embodiment of the invention.
Figure 10A:
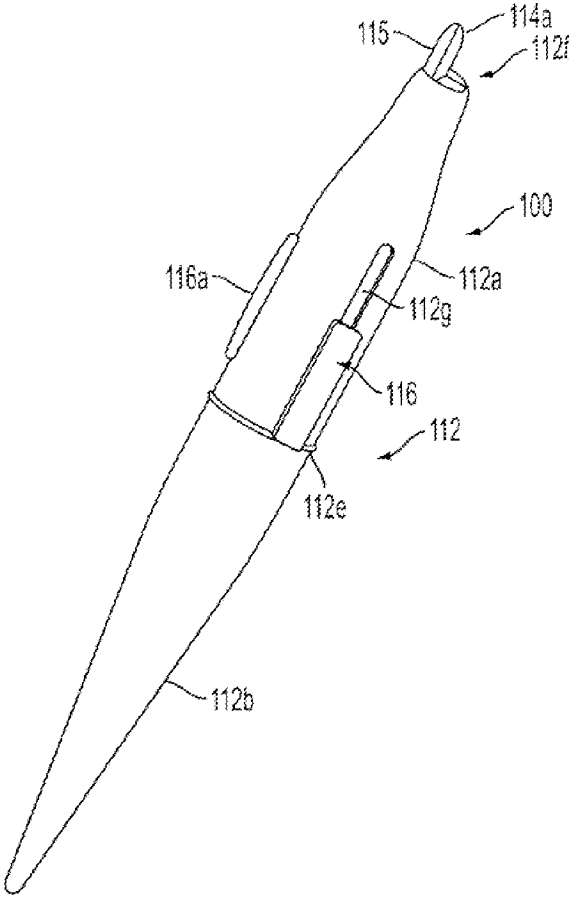
Figure 11B:
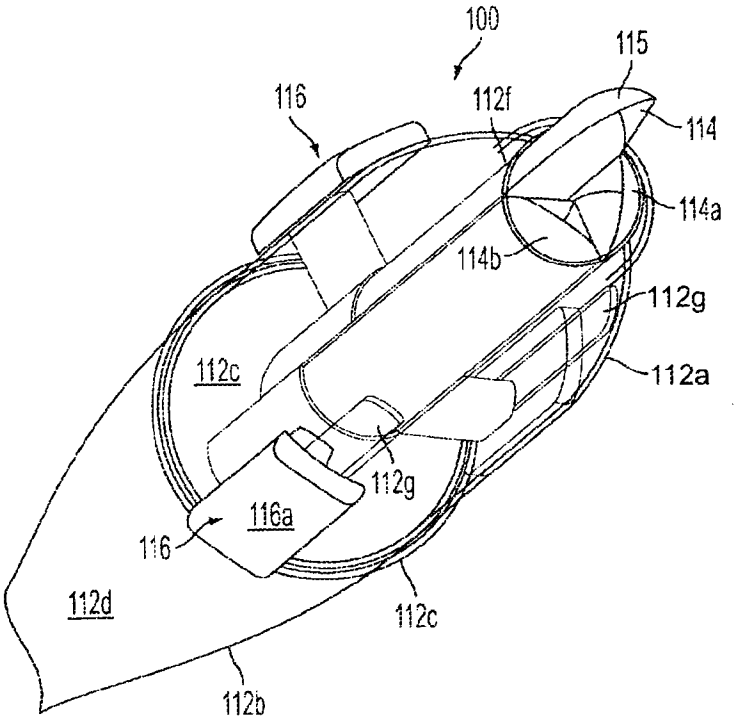
FIGS. 11*a* and 11*b* are, respectively, a front perspective view and a top view of multi-unit cosmetic applicator.
Figure 11A:
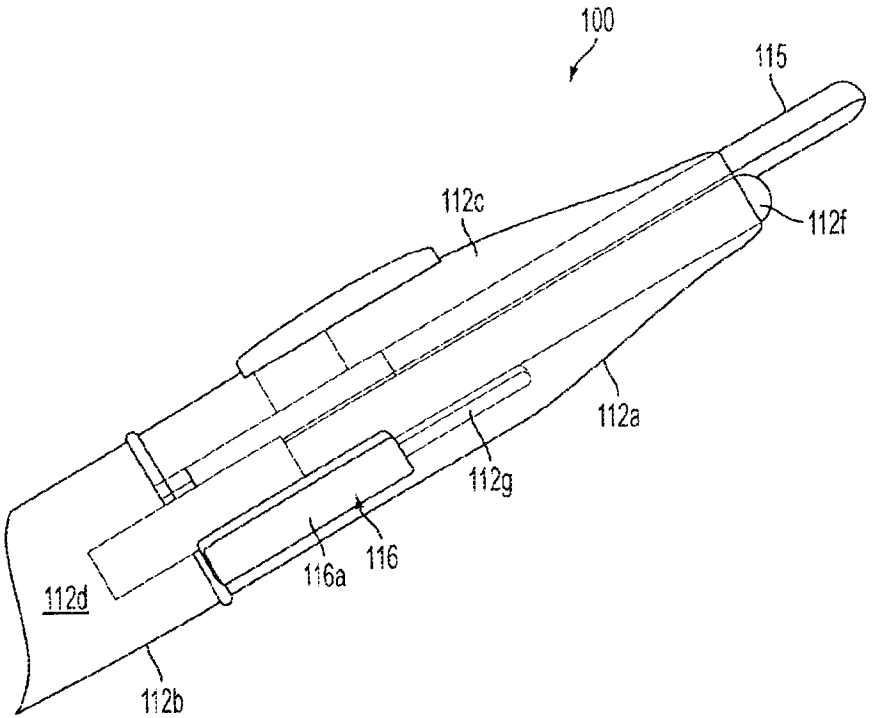
Figure 12C:
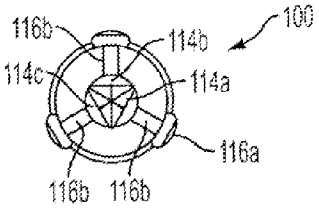
FIGS. 12*a*-12*e* are, respectively, a right-side view of multi-unit cosmetic applicator, a side partial see-through view of multi-unit cosmetic applicator, a top partial see-through view of multi-unit cosmetic applicator, a cross-sectional view of dual cosmetic applicator taken along line A-A of FIG. 12*a*, and a partial see-through view of a detail of area B of FIG. 12*a*.
Figure 12E:
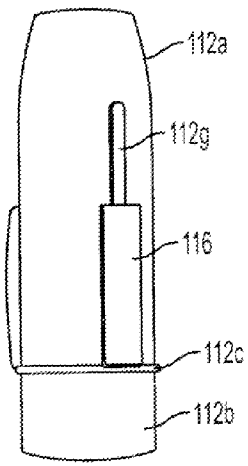
Figure 12D:
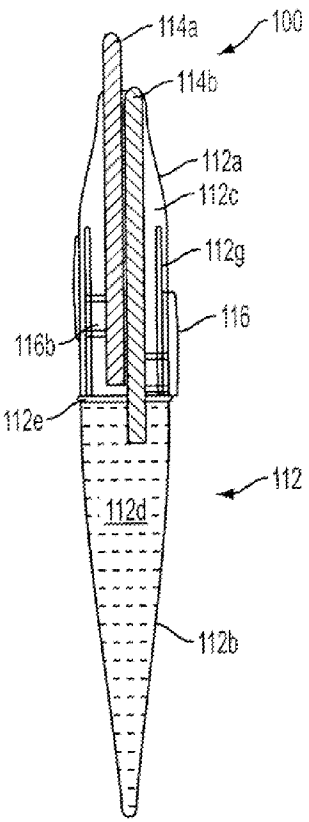
Figure 12B:
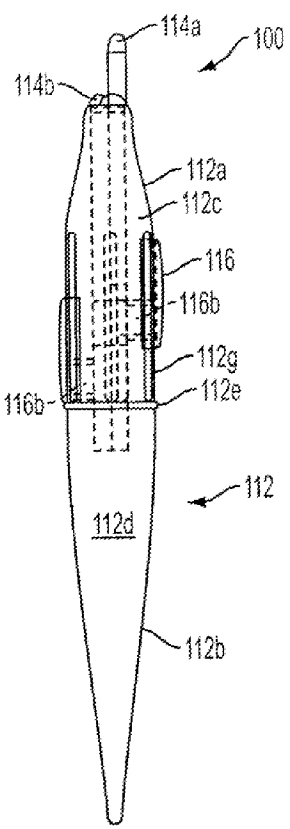
Figure 12A:
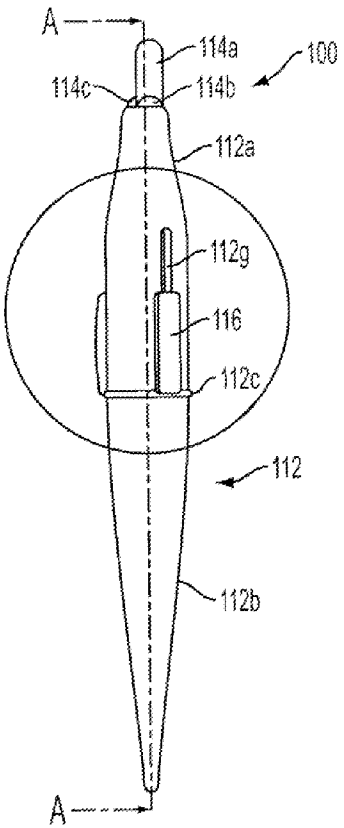

Therein, FIGS. 10*a* and 10*b* are, respectively, a right-side perspective view and a left-side perspective view, as of a multi-unit cosmetic applicator 100 in accordance with a further embodiment of the invention. FIGS. 11*a* and 11*b* are, respectively, a partial see-through side view view and front perspective view of multi-unit cosmetic applicator 100. FIGS. 12*a*-12*e* are, respectively, a right-side view of multi-unit cosmetic applicator 100, a side partial see-through view of multi-unit cosmetic applicator 100, a top partial see-through view of multi-unit cosmetic applicator 100, a cross-sectional view of dual cosmetic applicator 100 taken along line A-A of FIG. 12*a*, and a partial see-through view of a detail of area B of FIG. 12*a*.

Preferably, multi-unit cosmetic applicator 100 is made of plastic, metal, and/or thermoplastic elastomers, rubber, manufactured using blow molding, and assembled by snap-fit assembly. However, any other material, manufacturing, and/or assembly method may be used. Especially desired is to have certain portions of the housing made with anodized plastic materials to give an upscale and refined look.

Multi-unit cosmetic applicator 100 includes a housing 112 having an upper body 112*a* and a lower body 112*b* that are fixedly or removably joined by any known means. Upper body 112*a* defines a substantially longitudinal inner space 112*c* for one or more slider assemblies and cosmetic units. Lower body 112*b* comprises an inner space 112*d* configured to receive a portion of one or more cosmetic units when in a stored position.

Inner space 112*d* may be a void space or may also comprise one or more reservoirs that may each house a different cosmetic agent or the same cosmetic agent such as one taught in this application. If the cosmetic agent is fluid one or more reservoirs may be in fluid communication with one or more corresponding cosmetic units.

Housing 112 preferably is designed to have an attractive shape and yet be ergonomically designed to fit in the user's hand. An ergonomic design may include any desired shape that is found to be suitable. As illustrated, lower body 112*b* may be shaped to taper to a tip while upper housing body 112*a* has a broader, fuller shape. The upper and lower body may be joined together via a ring portion 112*e*.

Upper housing body 112*a* includes an opening 112*f*, suitable for passing a first cosmetic unit 114*a*, a second cosmetic unit 114*b*, and third cosmetic unit 114*c* through such an opening. Opening 112*f* defines a proximal end of housing 112, while the tip of lower body housing 112*b* defines a distal end. Upper housing body 112*a* also includes substantially one or more longitudinally oriented notches 112*g* into which a corresponding slider assembly 116 (to be taught hereinafter) are fitted.

Each of three cosmetic units has a substantially longitudinal shape that when in a stored position extends from a proximal end of housing 112 through inner space 112*c* into inner space 112*d* at the distal end of the cosmetic unit. In cross-section, each cosmetic unit may have any shape. It may be preferred for each cosmetic unit to represent portion of a larger unit; for example, a segment of a circle or a portion of a triangle. To permit unimpeded independent movement; each cosmetic unit is laterally spaced-apart from another. Thus, it should be appreciated that opening 112*f* includes a peripheral clearance to permit movement of the cosmetic units.

Using the slider assembly (to be taught hereinafter), each cosmetic unit is selectably moved relative to the other cosmetic units from a stored position in housing 112 so that a user accessible portion 115, of any length, of one or more cosmetic units extends beyond the distal end of the housing. When in an advanced position, each of the cosmetic units extends a portion beyond the proximal end of housing 112 to provide a respective user accessible portion 115.

To move the cosmetic units, multi-unit cosmetic applicator 100 includes one or more slide assembly 116. Each slide assembly 116 may include a button 116*a* having a textured surface to provide a tactile response to the user. Each slide assembly 116 includes an arm 116*b* that connects to a sleeve 116*c* to retain one of the cosmetic units.

When the user pushes slide assembly 116 via button 116*a*, longitudinally towards the opening and the housing, the respective cosmetic unit advances through the opening 112*f* and a portion 115 is suitably located for a user.

The following patents and patent publications are hereby incorporated by reference for all purposes:

U.S. Patent Publication 2005/0100388

U.S. Pat. No. 6,543,458; U.S. Pat. No. 6,497,524.

What is claimed is:

1. A multi-unit cosmetic applicator, comprising:

a housing including a single opening;

a first cosmetic unit comprising a first cosmetic agent;

a second cosmetic unit comprising a second cosmetic agent having a solid, semi-solid, or waxy structure;

a mechanism for independently advancing any length of said second cosmetic unit relative to said first cosmetic unit from a stored position through said single opening in said housing to an advanced position and returning said second cosmetic to said stored position, wherein said first cosmetic agent has a functionally different property from said second cosmetic agent, wherein said first and second cosmetic agents are depletable and are transferred during use; wherein said second cosmetic unit includes a longitudinal channel to accommodate said first cosmetic unit, and wherein said first cosmetic unit is disposed within said longitudinal channel such that a peripheral clearance exists between said first and second cosmetic units.

2. The multi-unit cosmetic applicator of claim 1, wherein said first cosmetic unit comprises a wicking substrate.

3. The multi-unit cosmetic applicator of claim 2, wherein said wicking substrate comprises one of cotton, flax, silk, polyester, rayon, and acrylic.

4. The multi-unit cosmetic applicator of claim 1, wherein each of the first and the second cosmetic agent comprises one of a lipstick, a lip liner, a lip gloss, and a lip balm.

5. The multi-unit cosmetic applicator of claim 4, wherein said first cosmetic agent is a lip liner, and wherein said second cosmetic agent is selected from a group consisting of a lipstick, a lip balm, and a lip gloss.

6. The multi-unit cosmetic applicator of claim 1, wherein said housing comprises a lower housing portion and an upper housing portion, said lower housing portion being rotatable with respect to said upper housing portion.

7. A multi-unit cosmetic applicator, comprising:

a housing having a proximal and a distal end, said housing comprising a single opening at said proximal end, a lower housing portion and an upper housing portion;

a first cosmetic unit comprising a first cosmetic agent;

a second cosmetic unit comprising a second cosmetic agent having a solid, semi-solid, or waxy structure;

wherein said first housing portion rotates relative to said second housing portion and thereby advances any length of said second cosmetic agent relative to said first cosmetic agent from a stored position to an advanced position and back to said stored position, wherein each of the first and the second cosmetic agent is depletable and transferred during use, and comprise one of a lipstick, a lip liner, a lip gloss, and a lip balm;

wherein said second cosmetic unit includes a longitudinal channel to accommodate said first cosmetic unit, and wherein said first cosmetic unit is disposed within said longitudinal channel such that a peripheral clearance exists between said first and second cosmetic units.

8. The multi-unit cosmetic applicator of claim 7, wherein said first second cosmetic agent is a lip gloss, and wherein said second cosmetic unit is selected from the group consisting of a lipstick and a lip balm.

9. A method of delivering a plurality of cosmetic agents using one multi-unit cosmetic applicator, the method comprising of the steps of:

supplying a multi-unit cosmetic applicator, said applicator comprising a housing having a single opening at a proximal end of said housing; a first cosmetic unit comprising a first cosmetic agent; a second cosmetic unit comprising a second cosmetic agent having a solid, semi-solid, or waxy structure; a mechanism for independently advancing any length of said second cosmetic unit relative to said first cosmetic unit from a stored position to an advanced position and back to the stored position through the single opening in said housing;

ensuring said second cosmetic unit is in a stored position;

applying said first cosmetic agent to a portion of a user's body;

initiating the mechanism for moving said second cosmetic unit thereby advancing a length of the second cosmetic unit through said single opening in said housing;

applying said second cosmetic agent to a portion of said user's body; and returning said second cosmetic agent to said stored position;

wherein said first cosmetic agent has a functionally different property from said second cosmetic agent, wherein said second cosmetic unit is depletable and is transferred during use; wherein said second cosmetic unit includes a longitudinal channel to accommodate said first cosmetic unit, and wherein said first cosmetic unit is disposed within said longitudinal channel such that a peripheral clearance exists between said first and second cosmetic units.

* * * * *